US007350741B1

(12) United States Patent
Rosa

(10) Patent No.: US 7,350,741 B1
(45) Date of Patent: Apr. 1, 2008

(54) LIGHT STRING WINDING APPARATUS

(76) Inventor: Linda S. Rosa, 14379 W. Farm Road 194, Billing, MO (US) 65610

( * ) Notice: Subject to any disclaimer, the term of this patent is extended or adjusted under 35 U.S.C. 154(b) by 0 days.

(21) Appl. No.: 11/595,158

(22) Filed: Nov. 9, 2006

Related U.S. Application Data

(60) Provisional application No. 60/734,407, filed on Nov. 9, 2005.

(51) Int. Cl.
*B65H 16/02* (2006.01)

(52) U.S. Cl. ..... 242/557; 242/403; 242/597.7

(58) Field of Classification Search ..... 242/557, 242/588, 588.3, 588.6, 597.7, 403, 403.1; 206/418, 419
See application file for complete search history.

(56) References Cited

U.S. PATENT DOCUMENTS

| | | | | |
|---|---|---|---|---|
| 2,890,005 | A | 6/1959 | Hoogestraat | |
| 2,896,877 | A * | 7/1959 | Vaughn | 242/557 |
| 4,369,614 | A * | 1/1983 | Tetzner | 242/557 |
| D339,976 | S | 10/1993 | Ferguson, Sr. | |
| 5,287,965 | A * | 2/1994 | Miller | |
| 5,425,518 | A | 6/1995 | Czerniak | |
| 5,482,226 | A * | 1/1996 | Choate | 242/588 |
| D375,251 | S * | 11/1996 | Stevens et al. | |
| 5,598,985 | A | 2/1997 | Winesett | |
| 5,941,388 | A * | 8/1999 | Spielberger | 206/419 |
| 5,957,401 | A | 9/1999 | O'Donnell | |
| 6,076,759 | A | 6/2000 | Simonson | |
| 6,398,148 | B1 | 6/2002 | Snow | |
| 6,557,792 | B1 | 5/2003 | Snow | |
| 6,926,145 | B2 * | 8/2005 | Bartlett | 242/557 |
| 7,198,153 | B2 * | 4/2007 | Shaffer | 206/419 |
| 2003/0080236 | A1 * | 5/2003 | Armstrong | 242/557 |
| 2005/0161359 | A1 * | 7/2005 | Shaffer | 206/419 |

* cited by examiner

*Primary Examiner*—William A Rivera
(74) *Attorney, Agent, or Firm*—Robert C. Montgomery

(57) ABSTRACT

An apparatus and method by which light strings can be quickly wound up and securely stored is herein disclosed. A freely rotating base and spindle assembly has a tray disposed along the shaft of the spindle upon which a reel assembly sits. The reel assembly has a number of interspaced grooves formed on its outer surface to retain a plurality of light strings and an inverted "U"-shaped device acting as a winding mechanism on its top surface. A cover assembly is provided to protect the wound light strings from the environment and a removably detachable handle for attachment to the spindle shaft is also provided. The spindle and base assembly is mounted on a wheeled cart to provide portability.

9 Claims, 3 Drawing Sheets

LIGHT STRING WINDING APPARATUS

RELATED APPLICATIONS

The present invention was first described in U.S. Provisional Patent Application No. 60/734,407, filed on Nov. 9, 2005.

FIELD OF THE INVENTION

The present invention relates generally to an apparatus and method by which light strings can be quickly wound up and securely stored and, more particularly, to a freely rotating base and spindle assembly with a tray disposed along the shaft of the spindle upon which a reel assembly sits and to a protective functional cover.

BACKGROUND OF THE INVENTION

Although string lights are used throughout the year in a variety of residential and commercial settings, perhaps the most prevalent time for installing and storing string light sets is during the end-of-the-year holiday season. Whether the lights are used on the exterior of a building structure or inside on a tree, lights are the one thing that truly makes the season magical. However, this magic quickly comes to an end when dealing with lights that were haphazardly stored after last season's use. First, the lights may have become broken from improper storage from the previous year. Second, if the lights are not broken, surely they are tangled, which requires time away from the festivities to untangle them. Finally, lights are typically stored in discrete coils, which make it difficult to locate and find the right set for the right spot. Then, at the conclusion of the holiday season, the lights are usually hastily taken down and improperly stored, ensuring that the above problems will be repeated again the following year.

The invention is a unique apparatus that aids in containing, storing, and dispensing strings of holiday lights. The invention takes the form of a wheeled base with a central, upright spindle. A reel on the spindle (capable of holding up to ten strings of lights) spins in either direction and allows the light stings to be stored or removed without putting a twist into the electrical cable. To remove the lights, they are simply pulled from the reel, which free-wheels to match the speed of dispensing. A round, tube-like cover is provided, which slides over the reel to protect the lights from breakage and dirt during storage. Finally, a handle is provided on the top of the reel, which extends through the cover and is used for not only turning the wheel when winding light strings back up, but for transporting the invention as well. The use of the light winding apparatus allows for the quick, easy, and efficient use of conventional electric Christmas lights during their application, retrieval, and storage cycles.

Several attempts have been made in the past to assist users in winding and storing light strings on a reel. U.S. Pat. No. 5,598,985, issued in the name of Winesett, discloses a Christmas light reel including a spool housing, a spool, a crank having a shaft passing through the spool and cord clips. The Winesett patent is not disposed to be a wheeled transport system and is not designed to store multiple strings of light as in the present invention.

U.S. Pat. No. 6,076,759, issued in the name of Simonson, teaches a Christmas light organizer including spaced apart panels with inner rods extending therebetween and outward of the panels. One of the inner rods has slots for retaining the prong of an electrical plug. Unfortunately, along with the Winesett design, there are no provisions for transporting and storing multiple light strings on a wheeled base, thereby allowing the user to maneuver the light string storage reel anywhere.

U.S. Pat. No. 5,425,518, issued in the name of Czerniak, describes a cord or wire holder for Christmas lights for fastening to an exterior location and as such, differs in scope of the present invention.

U.S. Pat. No. 2,890,005, issued in the name of Hoogestraat, teaches a portable wire reel for electric fence wire that is carried on the shoulders of a person, a crank-operated spool, and a friction brake for preventing backlash of the reel during unwinding. The Hoogestraat patent suffers from the same shortcomings as the previously mentioned patents in that it does not provide a wheeled device that also stores the light strings.

U.S. Pat. Nos. 6,557,792 and 6,398,148, both issued in the name of Snow, disclose a device and method for storing holiday light strings with a vertically disposed rotatable spindle with a plurality of spaced-apart protrusions for preventing sagging of the wound light string. However, the Snow devices also are not disposed on a wheeled base for transportation and they do not teach a cover for the wound light strings on the reel.

U.S. Pat. No. 5,957,401, issued in the name of O'Donnell, discloses a hand reel storage device for a holiday light string having a spool as well as devices to retain the light string on the reel. Unfortunately, the O'Donnell device has no provisions for a wheeled base for transporting the storage reel and, therefore, does not fall under the scope of the present invention.

Additionally, various patents have been issued based on an ornamental design for storage reels for light strings, notably D 339,976 issued in the name of Ferguson, Sr., and D 247,218 issued in the name of Barber.

None of the prior art particularly describes a portable device for winding, unwinding, and storing light strings—especially Christmas lights. Accordingly, there is a need for a means by which decorative holiday lights can be stored, applied, and removed in a manner that eliminates the drawbacks associated with conventional storage.

SUMMARY OF THE INVENTION

In view of the foregoing disadvantages inherent in the prior art, it has been observed that there is need of an apparatus and method that aids in the winding, dispersing, and storage of light strings—particularly Christmas lights.

It has further been observed that there is a need for a device that is maneuverable and easily transportable.

The object of the present invention is to provide a winding apparatus, comprising a spindle mounted into a base; a reel for retaining light strings; a cover portion; a detachable handle for pushing or pulling the apparatus; and a wheeled base unit for transportation.

Another object of the invention is to provide an apparatus fabricated of one or more durable materials such as, but not limited to: plastic, metal, wood, styrofoam, and cardboard.

Yet another object of the present invention is to provide a wheeled cart, typically of a low profile and sturdy enough to counterbalance the weight of the assembly during the operation of the apparatus. Attached to the cart base are four wheels fabricated out of heavy-duty tires to provide easy transport across any surface. The wheels are affixed to the base and have swivel attachments that rotate such that the wheels are in engagement with the ground in a readily stable stance capable of resisting overturning forces lined in a parallel orientation with that of the direction of motion.

Still yet another object of the present invention is to provide a base member of cylindrical design that is envisioned to support the apparatus having an overall diameter sizable to attach thereto the upper portion of the cart base so as to accommodate the weight of the apparatus and the lights.

Still yet another object of the present invention provides for a spindle, rotatably attached thereto said base, envisioned to comprise a circular cross-section, projecting vertically upwards at a designated distance. The spindle is rotatably attached transversally thereto the axial plane of the base, having an upper half comprising a suitable diameter to removably receive and accept a light string reel and a lower half rotatably affixed thereto the base and centrally positioned thereon, enabling the entire spindle assembly to freely rotate. A circular tray member is affixed at an intermediate position on the central shaft, having a diameter similar to or slightly larger than that of a reel cover to temporarily sustain a reel and/or a reel cover.

Yet another object of the present invention is to provide a removable reel, which rests upon the tray portion of the spindle, comprising a base member that rests upon the spindle tray; a central cylindrical portion of a lesser diameter, comprising interspaced circumferential grooves formed on its surface; a central guide hole of a diameter slightly larger than that of the spindle that is designed to receive said spindle and vertically oriented; and, a winding mechanism comprising an inverted "U"-shape that straddles the guide hole of the reel and provides enough clearance to allow the spindle to rotate freely and also to clear through the central slot of a cover member. The winding mechanism provides a means for a user to provide rotational movements of the spindle and the reel in a manner such that the spindle and reel rotate together with respect to said winding mechanism. The equidistantly-spaced grooves removably accept and retain light strings thereby preventing tangling of said light strings when wound about said reel.

Another object of the present invention is to provide a cover member for the reel, comprising a hollow cylindrical housing of the same diameter as said base of said reel. Centrally located on the top portion of said cover member is an orifice or slot to accommodate the passing of said winding mechanism of said reel when said cover member is placed over said reel. The cover member covers and retains therein said reel and wound light strings, and said slot limits movement of said winding mechanism and prevents unintentional unwinding of said light string. The cover member may further comprise a latching mechanism.

Another object of the present invention is to provide a handle assembly, comprising a clamping mechanism removably attached thereto said lower half of said spindle; a cylindrical, resilient shaft with a proximal end attached to said clamping mechanism perpendicular to said spindle, a distal end, and a first bent angle and a second bent angle so as to orient said distal end parallel to said spindle; and, a removably detachable ergonomic grip attached to said distal end of said shaft.

Another object of the present invention is to provide a locking mechanism for securing the wheel assembly in a locked position, thereby preventing unwanted wheel slippage.

To achieve the above and other objectives, a method for utilizing the present invention comprises the steps of: removing the cover member of the apparatus; verifying that the reel is resting on the tray member with the upper half of the spindle passing through the central guide hole; placing the handle assembly on a location thereon the lower half of the spindle so as to allow it to be easily maneuverable; transporting the apparatus via the wheeled cart to an area containing the light string by using the handle assembly to guide the apparatus; securing a lead end of the light string within the grooves of the reel; manipulating the winding mechanism in a circular motion by grasping the saddle of the inverted "U"-shape by hand and rotating the apparatus in a forward or a backward direction, wherein said rotating spins both halves of the spindle, the tray member, and the reel, while the user and winding mechanism remain in a fixed location and causes the light string to wind around the reel and itself to secure it within the grooves; repeating said manipulating of said winding mechanism for retaining additional light strings to be wound within additional grooves as necessary; placing the cover member by guiding the winding mechanism through the slot on the cover member; transporting said apparatus to an out-of-the-way place via the wheeled cart and the handle assembly; removing said handle assembly by detaching the clamping mechanism from the lower half of the spindle; removing the reel with the wound light strings and cover member from the upper half of the spindle; storing the reel with the wound light strings and cover member in a desired location; and, unwinding the wound light strings from the apparatus by reversing the preceding steps.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

Figure 1:
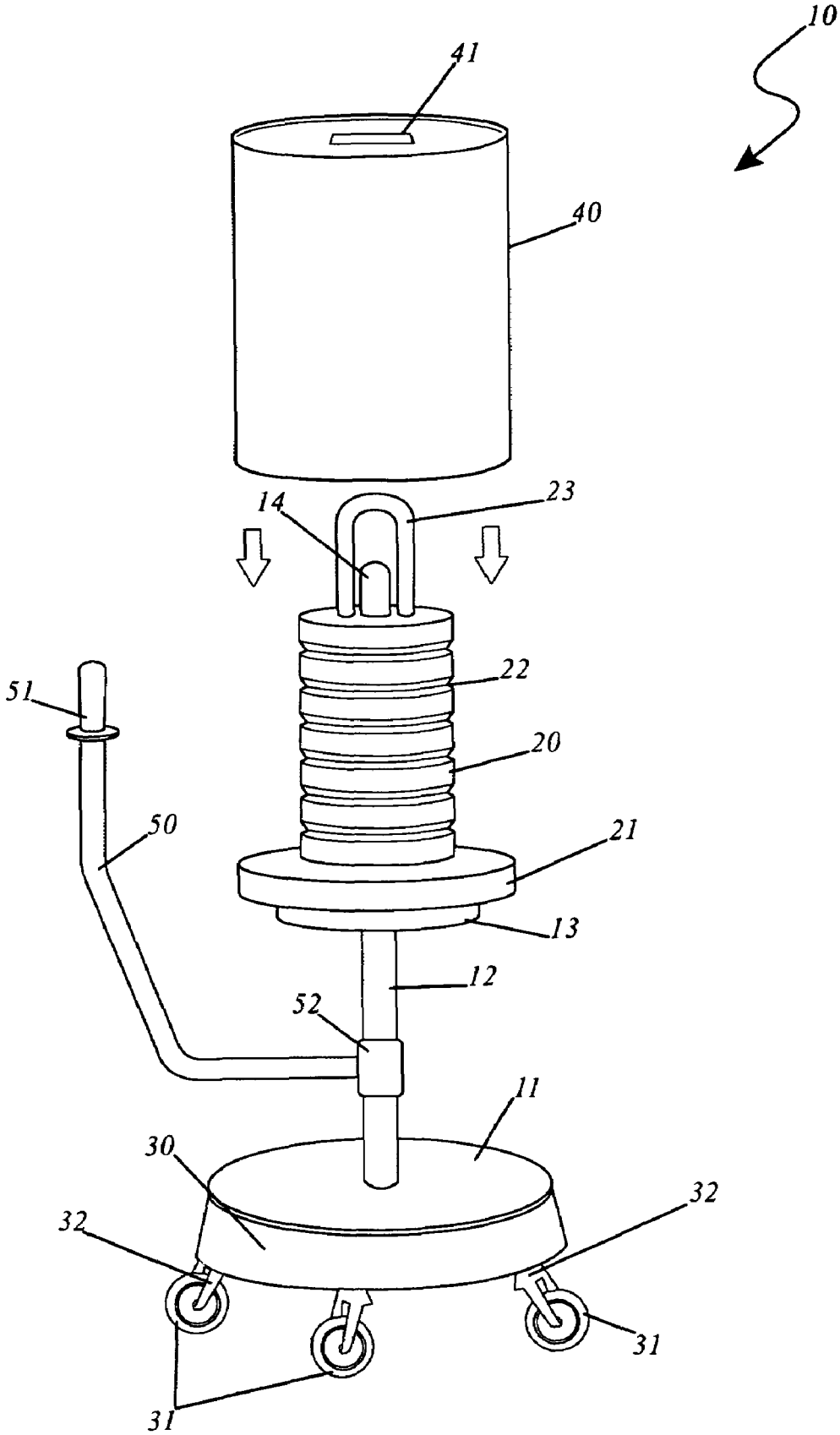
FIG. 1 is a front view of a Christmas light winder 10, according to the preferred embodiment of the present invention; and, FIG. 2 is a perspective view of the Christmas light winder 10, according to the preferred embodiment of the present invention; and, FIG. 3 is a close-up perspective view of a base 11 attached thereto a wheeled cart 30, according to the preferred embodiment of the present invention; and, FIG. 4 is a perspective view of the Christmas light winder 10 without a reel cover 40 and a handle 50, according to the preferred embodiment of the present invention; and, FIG. 5 is a close-up view of a clamping mechanism 52 removably attached thereto a lower half of a spindle 12, according to the preferred embodiment of the present invention.

10 light string winding apparatus
11 base
12 lower half of spindle
13 reel tray member
14 upper half of spindle
20 light string reel
21 reel base
22 groove
23 winding mechanism
30 cart
31 wheel
32 swivel attachment
40 reel cover member

41 winding mechanism slot
50 handle shaft
51 grip
52 detachable clamp
55 threaded screw

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an apparatus and method that aids in winding, dispersing, and storing light strings—particularly Christmas lights. The light string winding apparatus (herein described as the "apparatus") 10 comprises a spindle 12, 14 mounted into a base 11; a reel 20 for retaining Christmas or other light strings; a cover portion 40; a detachable handle 50 for pushing or pulling the apparatus 10; and a wheeled base unit 30 for transportation. The apparatus 10 is envisioned to be fabricated of one (1) or more durable materials such as, but not limited to: plastic, metal, wood, styrofoam, and cardboard.

Figure 2:
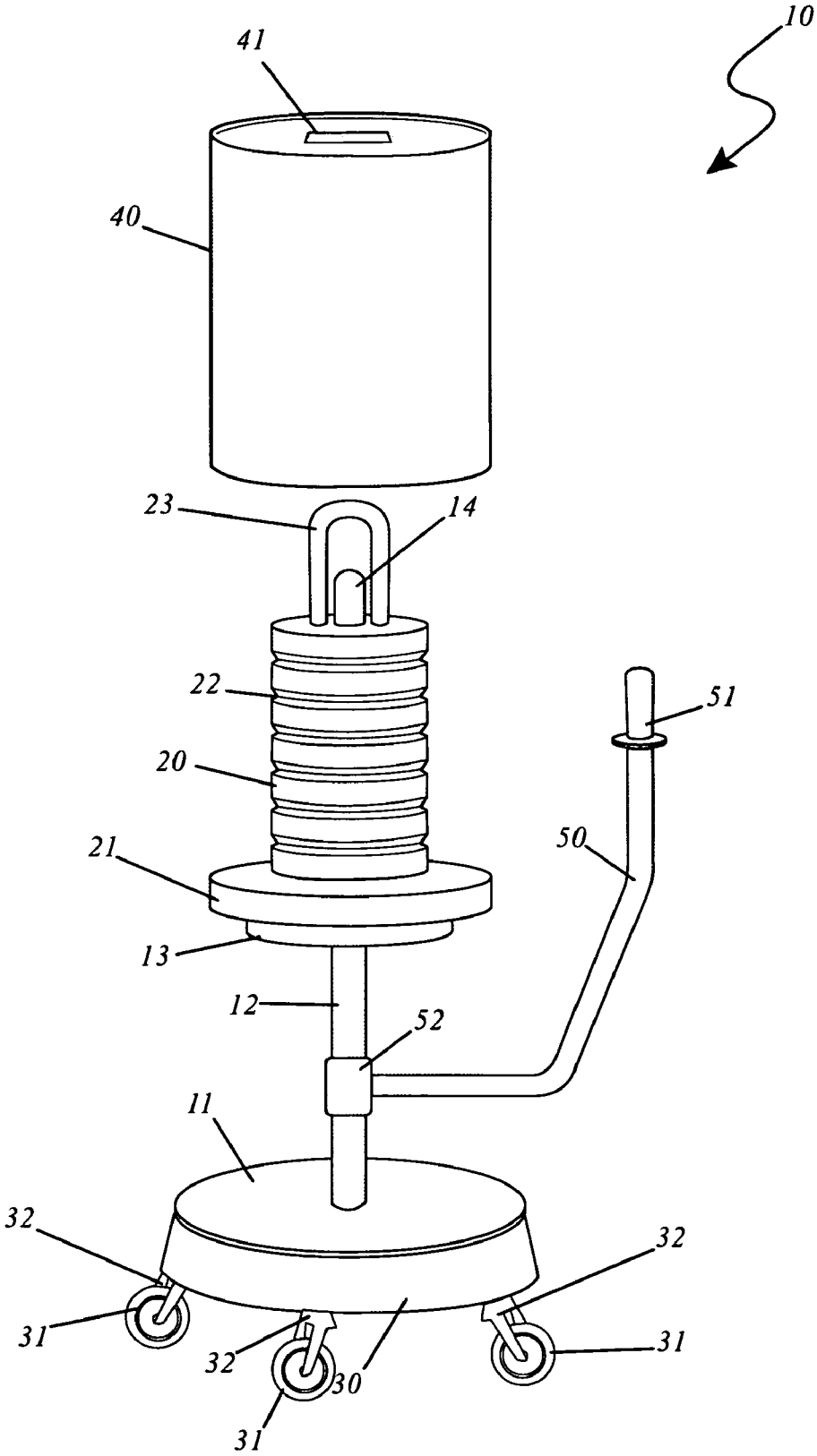
Figure 3:
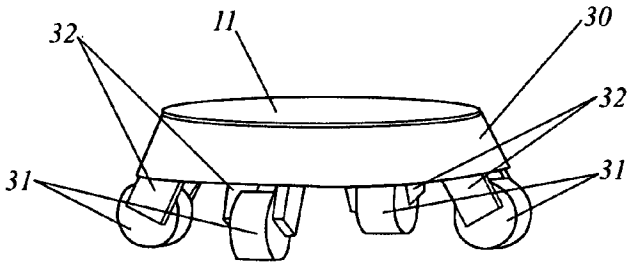

Referring now to FIGS. 1 through 3, views of the apparatus 10 and the base 11 attached thereto a wheeled cart 30, are disclosed according to the preferred embodiment of the present invention. The entire assembly that will subsequently described is mounted onto a wheeled cart 30 typically of a low profile and sturdy enough to counterbalance the weight of the assembly and any tangential forces created during the operation of the apparatus 10. Attached to the cart base 30 are four (4) wheels 31 with swivel attachments 32 to provide easy transport across any surface. The wheels 31 are envisioned to comprise a sizeable diameter so that there is ample space between the ground and the apparatus 10, thereby providing motion of the apparatus 10, even over small obstructions. The swivel attachments 32 are spinable about the longitudinal axis having a "U"-shape configuration extending beyond the wheels 31 thereof. During travel, the apparatus 10 is motioned in the desired direction and the swivel attachments 32 rotate such that the wheels 31 are in engagement with the ground in a readily stable stance capable of resisting overturning forces lined in a parallel orientation with that of the direction of motion. A base member 11 of cylindrical design is envisioned to support the apparatus 10 before, during, and after winding Christmas lights. The base 11 is of a cylindrical design, having an overall diameter sizable to attach thereto the upper portion of the cart base 30 so as to accommodate the weight of the apparatus 10 and the lights.

Figure 4:
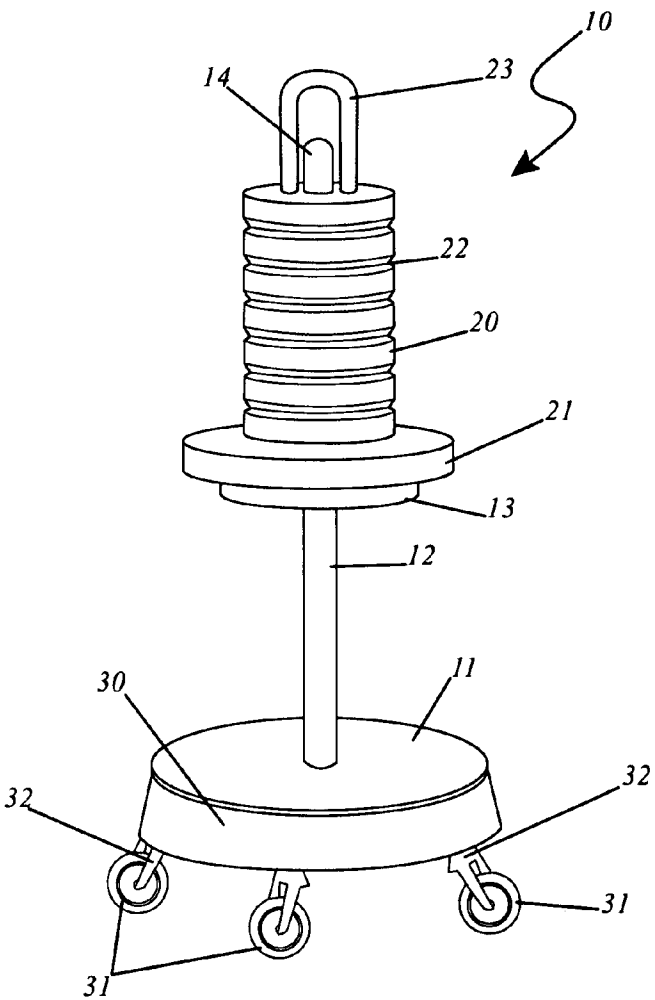

Referring now to FIG. 4, a perspective view of the apparatus 10, without a reel cover 40 and a handle 50, is disclosed according to the preferred embodiment of the present invention. The base 11 comprises a spindle 12, rotatably attached thereto, comprising a circular cross-section projecting vertically upwards at a designated distance. The spindle 12 is rotatably attached transversally thereto the axial plane of the base 11, comprising an upper half 14 and a bottom half 12 thereof such that the bottom half 12 is affixed thereto the base 11 thereof. The bottom half 12 is centrally positioned thereon the base 11, and the upper half 14 comprises a suitable diameter such to removably receive and accept a light string reel 20. The bottom half of the spindle 12 is attached to a base member 11, enabling the entire spindle assembly 12, 14 to freely rotate. The spindle portion 12, 14 of the present invention 10 is manufactured out of resilient material and has a general shape of a cylindrical shaft member extending through a circular tray member 13 and situated in an intermediate position on the central shaft and affixed thereto, thereby defining a top half 14 and a bottom half 12. The diameter of the tray 13 is similar or slightly larger than that of a reel cover 40 in order to temporarily sustain a reel 20 and/or a reel cover 40.

A removable reel 20, also of a resilient material of construction, rests upon the tray portion 13 of the spindle 12, 14. The reel 20 has a base member 21 that rests upon the spindle tray 13 and a central cylindrical portion of a lesser diameter with interspaced circumferential grooves 22 formed on its surface. A central guide hole of a diameter slightly larger than that of the spindle 14 and designed to receive said spindle 14 is vertically formed through the entire reel 20. Formed on the upper surface of the central reel portion 20 is an inverted "U"-shaped winding mechanism 23 that straddles the guide hole of the reel 20 and provides enough clearance to allow the spindle 14 to rotate freely and also to clear through the central orifice 41 of the exterior cover 40. The winding mechanism 23 provides a means for a user to provide rotational movements of the spindle 12, 14, hence the reel 20, in a manner such that the spindle 12, 14 and reel 20 rotate together with respect to said winding mechanism 23. The reel 20 also comprises a plurality of equidistantly spaced dividers or grooves 22 in a generally "V"-shaped configuration so as to removably accept and retain the Christmas light strings, thereby preventing tangling of the said light strings when wound about said reel 20. The grooves 22 further keep the string of Christmas lights in place while preventing excessive drooping or slumping, especially when said lights are in the process of being wound about the reel 20. The grooves 22 also prevent wound Christmas light strings from sagging during storage while wound about reel 20. Upon winding of said lights, the reel 20 retains a length of Christmas lights when wound thereabout. The bottommost or topmost groove 22 may be utilized for retaining the first end of the elongated string of lights in place.

A cover member 40, made of a resilient and waterproof material, covers the entire reel section 20 and is of generally the same diameter as the base 21 of the reel 20. The cover 40 takes the form of a hollow cylindrical housing to cover the reel 20, hence the wound Christmas lights, so as to protect and keep said lights. Centrally located on the top portion of the cover 40 is an orifice or slot 41 to accommodate the passing of the winding mechanism 23 therethrough when the cover 40 is placed over the reel section 20. The passing of the winding mechanism 23 therethrough the slot 41 prevents unintentional unwinding of the Christmas light string.

Figure 5:
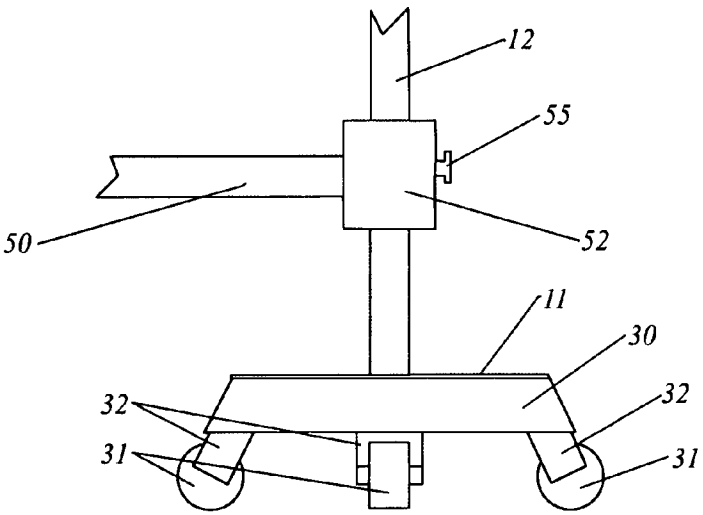

Referring now to FIG. 5, a close-up view of the clamping mechanism 52, removably attached thereto the lower half of a spindle 12, is disclosed according to the preferred embodiment of the present invention. Removably attached at an intermediary position on the bottom half of the spindle shaft 12 between the base member 11 and tray portion 13 is a handle 50. A cylindrical resilient shaft 50 is attached to a removable clamp 52, perpendicular to the spindle shaft 12, and is bent in two (2) or more places so as to orient the distal end parallel to the spindle shaft 12. The handle 50 generally takes the form of a shaft that is removably attachable to the lower half of the spindle 12 to a means to push and/or pull the apparatus 10. At the distal end of the handle 50 is a removably detachable ergonomic grip 51. A clamping mechanism 52 provides an adjustment means such that the handle 50 and grip 51 may adjustably and slidably move upwardly and downwardly along the lower half of the spindle 12 and releasably secured in a desired position thereon said lower half 12. Threaded screws 55 or the like may be inserted therewithin the clamping mechanism 52, comprising at least one (1) aperture defining bore for rotatably accepting said screw 55 so that the clamping mechanism 52 may be releasably secured. Alternate fastening mechanisms may be used to releasably secure the handle 50 and handle grip 51 thereto the lower half of the spindle 12. Whenever desired, the cover 40 may be removed, thereby allowing the free rotational movement of the spindle 12, 14, hence the reel 20, thereby allowing the elongated string of lights to be freely unwound from the reel 20 by a user. Removing the cover 40 allows the reel 20 to rotate thereabout so that the string of lights can freely unwind from said reel 20.

The preferred embodiment of the present invention can be utilized by the common user, who has little or no training, in a simple and effortless manner. After initial purchase or acquisition of the apparatus 10, it would be configured as indicated in FIGS. 1 through 5.

To operate the present invention 10, a single light string or plurality of light strings must be readily available. The cover 40 of the apparatus 10 must be removed and the light string reel 20 must be verified to rest on the reel tray 13 with the top half of the spindle 14 passing through its center. The apparatus 10, after verifying that the handle 50 is secured to the bottom half of the spindle 12, is then transported via the wheeled cart 30 to the area containing the light string by using the handle assembly 50 to guide the apparatus 10. The handle 50 may be placed anywhere on the lower half of the spindle 12 as to allow it to be easily maneuverable by the user.

To begin winding the light string onto the reel 20, the user secures one end of the light string within the grooves 22 of the reel 20 and begins to manipulate the winding mechanism 23 in a circular motion by grasping the "U" shaped mechanism 23 and rotating the entire assembly in the forward or backward direction. This, in effect, spins both halves of the spindle 12, 14, the reel tray 13, and the reel assembly 20 while the user and winding mechanism 23 remain in one location. This winding motion causes the light string to wind around the reel 20 and, eventually, around itself to help secure it within the grooves 22 of the reel assembly 20. The plurality of grooves 22 allow for the apparatus 10 to retain a number of light strings on the reel assembly 20.

Once the light string or strings have been wound on the reel assembly 20, the user then places the cover assembly 40 by guiding the winding mechanism 23 through the slot 41 on the cover 40. This action also prevents the accidental unwinding of the reel 20 inasmuch as the winding mechanism 23 cannot rotate with the cover 40 on due to the dimensions of the slot 41. For prolonged storage, the apparatus 10 can be transported to an out-of-the-way place via the wheeled cart 30 and the handle assembly 50 may be removed by detaching the clamp 52 from the bottom half of the spindle 12. The reel assembly 20 with the wound light strings and cover assembly 40 is then removed from the top half of the spindle 14 and then placed in its desired location.

When it is desired to unwind the light strings from the apparatus 10, the preceding steps may be followed, noting that the cover 40 must be removed prior to any action.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A winding apparatus for retaining and storing light strings, comprising:

a wheeled base assembly, further comprising:

a circular base with a first diameter, four swivel attachments equidistantly affixed to a bottom surface of said base, four wheel assemblies rotatably affixed to said swivel attachments such that said wheels are in engagement with a ground surface;

a spindle rotatably attached thereto said wheeled base assembly, further comprising:

a cylindrical rod projecting upwardly at a height and a circular tray member with a second diameter, said tray member affixed at an intermediate position on said rod, thereby defining a lower half and an upper half of said rod;

a reel mounted thereon said spindle for retaining light strings;

a cover member for covering said spindle and said reel; and, a handle removably attachable to said spindle for pushing or pulling said apparatus;

wherein said lower half of said spindle is rotatable attached transversally thereto and centrally positioned thereon an axial plane of said circular base enabling said spindle to freely rotate, and said upper half comprising a spindle diameter to removably receive said reel.

2. The apparatus of claim 1, wherein said reel rests upon said tray member of said spindle, comprising a base member with a third diameter sized to rests upon said tray member; a central cylindrical portion with a fourth diameter, further comprising a plurality of inter-spaced circumferential grooves formed on said central portion; a central guide hole vertically oriented within said reel, further comprising a reel diameter slightly larger than that of said spindle diameter to receive said upper half of said rod of said spindle; and, a winding mechanism comprising an inverted "U"-shape that straddles said central guide hole of said reel to provide a clearance to enable said spindle to rotate freely;

wherein said winding mechanism provides a means for a user to provide a rotational movement of said spindle and said reel, and said circumferential grooves removably accept and retain said light strings, thereby preventing tangling of said light strings when wound about said reel.

3. The apparatus of claim 2, wherein said cover member comprises an open-ended cylindrical housing with an open end and a closed end, comprising a fifth diameter matching said third diameter, and a slot centrally located on said closed end of said cover member;

wherein said slot accommodates said winding mechanism of said reel when said cover member is placed over said reel and said open end rests thereupon said base member, said slot limits movement of said winding mechanism and prevents unintentional unwinding of said light strings when wound about said reel.

4. The apparatus of claim 3, wherein said handle assembly further comprises:

a clamping mechanism removably attached thereto said lower half of said spindle;

a cylindrical resilient shaft with a proximal end attached to said clamping mechanism perpendicular to said spindle;

a distal end;

a first bent angle and a second bent angle so as to orient said distal end parallel to said spindle; and, a removably detachable ergonomic grip attached to said distal end of said shaft.

5. The apparatus of claim 4, wherein said wheeled base further comprises a low profile and resilient manufacture to counterbalance a combined weight of said apparatus and wound light strings, particularly during operation of said apparatus.

6. The apparatus of claim 5, further comprising at least one locking mechanism for securing at least one wheel assembly in a locked position, thereby preventing unwanted wheel slippage.

7. The apparatus of claim 6, further comprising a latching mechanism for securing said cover member to said base member of said reel.

8. A system and a method for the efficient installation, removal and storage of light strings, comprising the steps of:

providing a winding apparatus for retaining and storing light strings, further comprising:

a wheeled base assembly, further comprising:

a circular base with a first diameter;

four swivel attachments equidistantly affixed to a bottom surface of said base;

four wheel assemblies rotatably affixed to said swivel attachments such that said wheels are in engagement with a ground surface; and, at least one locking mechanism for securing at least one wheel assembly in a locked position, thereby preventing unwanted wheel slippage;

a spindle rotatably attached thereto said circular base of said wheeled base assembly, further comprising:

a cylindrical rod projecting upwardly at a height; and, a circular tray member with a second diameter, said tray member affixed at an intermediate position on said rod, thereby defining a lower half and an upper half of said rod, wherein said lower half of said spindle is rotatably attached transversally thereto and centrally positioned thereon an axial plane of said circular base enabling said spindle to freely rotate, and said upper half comprising a spindle diameter to removably receive a reel;

said reel mounted thereon said tray member of said spindle, further comprising:

a base member with a third diameter sized to rests upon said tray member;

a central cylindrical portion with a fourth diameter;

a plurality of inter-spaced circumferential grooves formed on said central portion, wherein said circumferential grooves removably accept and retain said light strings, thereby preventing tangling of said light strings when wound about said reel;

a central guide hole vertically oriented within said reel, further comprising a reel diameter slightly larger than that of said spindle diameter to receive said upper half of said rod of said spindle; and, a winding mechanism comprising an inverted "U"-shape that straddles said central guide hole of said reel to provide a clearance to enable said spindle to rotate freely, wherein said winding mechanism provides a means for a user to provide a rotational movement of said spindle and said reel;

a cover member for covering said spindle and said reel, further comprising:

an open-ended cylindrical housing with an open end and a closed end, comprising a fifth diameter matching said third diameter, wherein said open end rests thereupon said base member; and, a slot centrally located on said closed end of said cover member, wherein said slot accommodates said winding mechanism of said reel when said cover member is placed over said reel, said slot limits movement of said winding mechanism and prevents unintentional unwinding of said light strings when wound about said reel; and, a handle removably attachable to said spindle for pushing or pulling said apparatus, further comprising:

a clamping mechanism removably attached thereto said lower half of said spindle;

a cylindrical resilient shaft with a proximal end attached to said clamping mechanism perpendicular to said spindle;

a distal end;

a first bent angle and a second bent angle so as to orient said distal end parallel to said spindle; and, a removably detachable ergonomic grip attached to said distal end of said shaft;

removing said cover member of said apparatus;

verifying said reel is resting on said tray member with said upper half of said spindle passing through said central guide hole;

placing said handle assembly on a location thereon said lower half of said spindle so as to allow said apparatus to be easily maneuverable;

transporting said apparatus via said wheeled base assembly to an area containing said light strings by using said handle assembly to guide said apparatus;

securing a lead end of a light string within said circumferential grooves of said reel;

manipulating said winding mechanism in a circular motion by grasping said inverted "U"-shape by hand and rotating said apparatus in a forward or a backward direction, thereby spinning said spindle, said tray member, and said reel while said user and winding mechanism remain in a fixed location, causing said light string to wind around said reel and itself to secure it within said grooves;

repeating said manipulating of said winding mechanism for retaining additional light strings to be wound within additional grooves, as necessary;

placing said cover member on said apparatus by guiding said winding mechanism through said slot on said cover member;

transporting said apparatus to a storage location via said wheeled cart with said handle assembly;

removing said handle assembly by detaching said clamping mechanism from said lower half of said spindle;

removing said reel with said light strings and cover member from said upper half of said spindle;

storing said reel with said light strings and cover member in said storage location; and, unwinding said wound light strings from said apparatus, by reversing the preceding steps.

9. A winding apparatus for retaining and storing light strings, comprising:

a wheeled base assembly, further comprising:

a circular base with a first diameter;

four swivel attachments equidistantly affixed to a bottom surface of said base;

four wheel assemblies rotatably affixed to said swivel attachments such that said wheels are in engagement with a ground surface; and, at least one locking mechanism for securing at least one wheel assembly in a locked position, thereby preventing unwanted wheel slippage;

a spindle rotatably attached thereto said circular base of said wheeled base assembly, further comprising:

a cylindrical rod projecting upwardly at a height; and, a circular tray member with a second diameter, said tray member affixed at an intermediate position on said rod, thereby defining a lower half and an upper half of said rod, wherein said lower half of said spindle is rotatably attached transversally thereto and centrally positioned thereon an axial plane of said circular base enabling said spindle to freely rotate, and said upper half comprising a spindle diameter to removably receive a reel;

said reel mounted thereon said tray member of said spindle, further comprising:

a base member with a third diameter sized to rests upon said tray member;

a central cylindrical portion with a fourth diameter;

a plurality of inter-spaced circumferential grooves formed on said central portion, wherein said circumferential grooves removably accept and retain said light strings, thereby preventing tangling of said light strings when wound about said reel;

a central guide hole vertically oriented within said reel, further comprising a reel diameter slightly larger than that of said spindle diameter to receive said upper half of said rod of said spindle; and, a winding mechanism comprising an inverted "U"-shape that straddles said central guide hole of said reel to provide a clearance to enable said spindle to rotate freely, wherein said winding mechanism provides a means for a user to provide a rotational movement of said spindle and said reel;

a cover member for covering said-spindle and said reel, further comprising:

an open-ended cylindrical housing with an open end and a closed end, comprising a fifth diameter matching said third diameter, wherein said open end rests thereupon said base member; and, a slot centrally located on said closed end of said cover member, wherein said slot accommodates said winding mechanism of said reel when said cover member is placed over said reel, said slot limits movement of said winding mechanism and prevents unintentional unwinding of said light strings when wound about said reel; and, a handle removably attachable to said spindle for pushing or pulling said apparatus, further comprising:

a clamping mechanism removably attached thereto said lower half of said spindle;

a cylindrical resilient shaft with a proximal end attached to said clamping mechanism perpendicular to said spindle;

a distal end;

a first bent angle and a second bent angle so as to orient said distal end parallel to said spindle; and, a removably detachable ergonomic grip attached to said distal end of said shaft.

* * * * *